US010280476B2

(12) United States Patent
Mizoguchi et al.

(10) Patent No.: US 10,280,476 B2
(45) Date of Patent: May 7, 2019

(54) H-SECTION STEEL AND METHOD OF PRODUCING THE SAME

(71) Applicant: NIPPON STEEL & SUMITOMO METAL CORPORATION, Tokyo (JP)

(72) Inventors: Masaki Mizoguchi, Kimitsu (JP); Kazutoshi Ichikawa, Kimitsu (JP); Kazuaki Mitsuyasu, Osaka (JP); Hirokazu Sugiyama, Tokyo (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 229 days.

(21) Appl. No.: 15/129,518

(22) PCT Filed: Apr. 9, 2015

(86) PCT No.: PCT/JP2015/061107
§ 371 (c)(1),
(2) Date: Sep. 27, 2016

(87) PCT Pub. No.: WO2015/159793
PCT Pub. Date: Oct. 22, 2015

(65) Prior Publication Data

US 2017/0107589 A1 Apr. 20, 2017

(30) Foreign Application Priority Data

Apr. 15, 2014 (JP) ..... 2014-084017

(51) Int. Cl.
*C21D 9/00* (2006.01)
*C21D 8/00* (2006.01)
(Continued)

(52) U.S. Cl.
CPC ..... *C21D 9/0068* (2013.01); *B22D 25/02* (2013.01); *C21C 7/0006* (2013.01); *C21C 7/06* (2013.01);
(Continued)

(58) Field of Classification Search
CPC ..... C21D 9/0068; C21D 8/005; C21C 7/06; C22C 33/04; C22C 38/00; C22C 38/001;
(Continued)

(56) References Cited

U.S. PATENT DOCUMENTS 6,364,967 B1 4/2002 Yamamoto et al.
9,482,005 B2 * 11/2016 Mizoguchi ..... C22C 38/06
(Continued)

FOREIGN PATENT DOCUMENTS

EP 1143023 A1 10/2001
EP 2792761 A1 10/2014
(Continued)

OTHER PUBLICATIONS

English translation of JP 2011/106006, Jun. 2011; 17 pages.*
(Continued)

*Primary Examiner* — Helene Klemanski
(74) *Attorney, Agent, or Firm* — Birch, Stewart, Kolasch & Birch, LLP

(57) ABSTRACT

An H-section steel has a predetermined chemical composition, in which a Mg-containing oxide having an equivalent circle diameter of 0.005 μm to 0.5 μm is contained at a total number density of 100 pieces/mm$^2$ to 5000 pieces/mm$^2$, a thickness of a flange is 100 mm to 150 mm, at a strength evaluation portion which is at a ⅙ position from a surface of the flange in a length direction and at a ¼ position from the surface in a thickness direction, a fraction of bainite in a steel structure is 80% or more, and the average prior austenite grain size is 70 μm or more, and at a toughness evaluation portion which is at a ½ position from the surface of the flange in the length direction and at a ¾ position from the surface of the flange in the thickness direction, the average prior austenite grain size in a steel structure is 200 μm or less.

6 Claims, 1 Drawing Sheet

(51) Int. Cl.

| | |
|---|---|
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/12*** | (2006.01) |
| ***C22C 38/14*** | (2006.01) |
| ***C22C 38/16*** | (2006.01) |
| ***C22C 38/42*** | (2006.01) |
| ***C22C 38/44*** | (2006.01) |
| ***C22C 38/46*** | (2006.01) |
| ***C22C 38/50*** | (2006.01) |
| ***C22C 38/58*** | (2006.01) |
| ***C22C 33/04*** | (2006.01) |
| ***C21C 7/06*** | (2006.01) |
| ***B22D 25/02*** | (2006.01) |
| ***C22C 38/00*** | (2006.01) |
| ***C21C 7/00*** | (2006.01) |
| ***E04C 3/06*** | (2006.01) |
| *E04C 3/04* | (2006.01) |

(52) U.S. Cl.

CPC ..... *C21D 8/00* (2013.01); *C21D 8/005* (2013.01); *C22C 33/04* (2013.01); *C22C 38/00* (2013.01); *C22C 38/001* (2013.01); *C22C 38/002* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/42* (2013.01); *C22C 38/44* (2013.01); *C22C 38/46* (2013.01); *C22C 38/50* (2013.01); *C22C 38/58* (2013.01); *E04C 3/06* (2013.01); *E04C 2003/0421* (2013.01); *E04C 2003/0452* (2013.01)

(58) Field of Classification Search

CPC ..... C22C 38/002; C22C 38/02; C22C 38/04; C22C 38/06; C22C 38/08; C22C 38/12; C22C 38/14; C22C 38/16; C22C 38/42; C22C 38/44; C22C 38/46; C22C 38/50; C22C 38/52; B22D 25/02; E04C 2003/0452

USPC ..... 420/120, 126, 127, 128; 148/579, 641

See application file for complete search history.

(56) References Cited

U.S. PATENT DOCUMENTS

| | | | | |
|---|---|---|---|---|
| 9,834,931 | B2 * | 12/2017 | Mizoguchi | C22C 38/06 |
| 9,863,022 | B2 * | 1/2018 | Ichikawa | C22C 38/001 |
| 2016/0376675 | A1 * | 12/2016 | Mizoguchi | C22C 38/001 428/598 |

FOREIGN PATENT DOCUMENTS

| | | | | |
|---|---|---|---|---|
| EP | 2975149 | A1 | | 1/2016 |
| JP | 5-263182 | A | | 10/1993 |
| JP | 7-216498 | A | | 8/1995 |
| JP | 8-283900 | A | | 10/1996 |
| JP | 8-283902 | A | | 10/1996 |
| JP | 9-111397 | A | | 4/1997 |
| JP | 10-147834 | A | | 6/1998 |
| JP | 10-204572 | A | | 8/1998 |
| JP | 11-131188 | A | | 5/1999 |
| JP | 2000-054060 | A | | 2/2000 |
| JP | 2000-328174 | A | | 11/2000 |
| JP | 2011/106006 | | * | 6/2011 |
| WO | WO 2011/065479 | A1 | | 6/2011 |
| WO | WO 2013/089089 | A1 | | 6/2013 |
| WO | WO 2014/142060 | A1 | * | 9/2014 |
| WO | WO 2015/093321 | A1 | * | 6/2015 |

OTHER PUBLICATIONS

Japanese Notice of Allowance, dated Jun. 27, 2017, for corresponding Japanese Application No. 2016-513744, with an English translation.

International Search Report (PCT/ISA/210) issued in PCT/JP2015/061107, dated May 26, 2015.

Written Opinion (PCT/ISA/237) issued in PCT/JP2015/061107, dated May 26, 2015.

Extended European Search Report, dated Sep. 11, 2017, for corresponding European Application No. 15780168.9.

"Method for Charpy Pendulum Impact Test of Metallic Materials," JIS Z 2242, 2005, pp. 364-375 (26 pages total) with Machine translation.

European Office Action for counterpart European Application No. 15780168.9, dated Jun. 15, 2018.

* cited by examiner

H-SECTION STEEL AND METHOD OF PRODUCING THE SAME

TECHNICAL FIELD OF THE INVENTION

The present invention relates to a high strength ultra thick H-section steel having excellent toughness suitable for a structural member for building structures.

Priority is claimed on Japanese Patent Application No. 2014-084017, filed on Apr. 15, 2014, the content of which is incorporated herein by reference.

RELATED ART

In recent years, as massive buildings such as high-rise buildings have been constructed, steels that are used therefor have been increased in thickness. Particularly, for supertall buildings, using of H-section steel having a flange thickness of 100 mm or more (hereinafter, referred to ultra thick H-section steel) is desired.

In general, as the strength of a steel material increases, or the thickness of a product increases, the toughness tends to deteriorate. Therefore, it is difficult to ensure the toughness of high strength thick steel.

In addition, H-section steel has a specific shape. Although it is preferable that the H-section steel is produced by universal rolling, the rolling conditions (temperature and reduction) are limited in the universal rolling. Therefore, particularly, in the production of an ultra thick H-section steel, the temperature history and a reduction during rolling, and a cooling rate during accelerated cooling significantly vary depending on each region of a web, flanges, and fillets. As a result, the strength, ductility, and toughness significantly vary in the cross section of an ultra thick H-section steel produced by rolling.

Further, in a case where an ultra thick H-section steel is produced by applying hot rolling to steel pieces obtained through continuous casting, it is difficult to ensure a desired toughness by enhancing the toughness through refinement of grains particularly in regions far from the surface of the steel, such as the thickness center portion of a flange or fillets. This is because it takes more time to roll an ultra thick H-section steel compared to a case of rolling a typical thick steel plate, and as a result, the temperature of the inside of the H-section steel at the time when rolling is finished is likely to become higher than the temperature of the surface.

In the related art, regarding the improvement of the toughness of an H-section steel, for example, Patent Documents 1 and 2 proposes a method of refining grains by dispersing Ti-based oxides in the steel and accelerating the formation of intragranular ferrite by the Ti oxides. In addition, for example, Patent Document 3 proposes a method of producing a rolled section steel having high strength and excellent toughness through refinement of ferrite grains by dispersing Ti oxides in the steel as nuclei of ferrite formation, and through temperature controlled rolling and accelerated cooling.

Patent Document 4 discloses a method of providing a rolled section steel that has a prior austenite grain size of 40 μm or less and has high strength and excellent toughness through structural refinement by fine dispersion of Mg-based complex oxides and TiN and through the formation of a fine bainite structure using accelerated cooling type controlled rolling. In addition, Patent Document 5 proposes a method of refining grains through dispersion of Mg-based oxides having a size of 1 μm or more at a density of 20 pieces/mm$^2$ or more and through acceleration of the formation of intragranular ferrite. Further, Patent Document 6 discloses the production of rolled section steel having high strength and excellent toughness by causing Mg-containing oxides of 3 μm or less to be in a cast slab at a density of 20 pieces/mm$^2$ or more and thus dispersing Mg-based oxides in the steel, and applying temperature controlled rolling and accelerated cooling to the steel and thus enabling the Mg-containing oxides to act as nuclei of ferrite transformation in prior austenite grains.

However, in the steel of Patent Document 1, the fraction of bainite in the structure is 40% or less and ferrite is contained in a high proportion. Therefore, it is thought that this is advantageous in ensuring toughness. However, there is a need to add a large amount of alloying elements such as Ni, Cu, Nb, and V in order to ensure such strength, and this is significantly disadvantageous in terms of costs. In Patent Document 2, a cooling rate in Example in which recuperation is not performed after accelerated cooling is as low as 1° C./s or lower, and there is a need to add a large amount of alloys such as Mn, Ni, Cu, and the like in order to ensure the strength. Therefore, this is disadvantageous in terms of costs. In Patent Document 3, the formation of intragranular ferrite from Ti oxides does not occur in components designed to transform a structure to bainite even when a cooling rate is low. Therefore, the method cannot be applied to steels based on such components. In Patent Document 4, in a case where a prior austenite grain size is 40 μm or less, even when accelerated cooling is applied, an ultra thick H-section steel formed at a cooling rate of lower than 10° C./s has insufficient hardenability, and it is thought that sufficient strength cannot be obtained. In addition, in Patent Document 4, there is also provided a technique of performing a water cooling and rolling cycle including water cooling of the surface of the flange of a section steel to 700° C. or lower in a rolling process and rolling of the resultant in a recuperation process, one or more times. It is thought that this is aimed at enabling the surface part and the inside of a steel to have a temperature difference, enhancing reduction penetration into the inside of a steel at a high temperature to introduce machining dislocation that acts as nuclei of bainite formation in austenite grains even under light reduction conditions, and increasing the nuclei. However, it is thought that in an ultra thick H-section steel having a flange thickness of 100 mm or more, refinement of austenite grains in the thickness center portion has no effect.

In Patent Document 5, since a large amount of coarse oxides of 1 μm or more is contained, there is a problem in that the oxides become the origin of brittle fracture, and a toughness value may vary. Regarding Patent Document 6, similar to Patent Document 3, the formation of intragranular ferrite from Mg-containing oxides does not occur in components designed to transform a structure to bainite even when a cooling rate is low. Therefore, the disclosure cannot be applied to steels based on such components.

PRIOR ART DOCUMENT

Patent Document

[Patent Document 1] Japanese Unexamined Patent Application, First Publication No. 2000-54060

[Patent Document 2] PCT International Publication No. WO2011/065479

[Patent Document 3] Japanese Unexamined Patent Application, First Publication No. H5-263182

[Patent Document 4] Japanese Unexamined Patent Application, First Publication No. H10-147834

[Patent Document 5] Japanese Unexamined Patent Application, First Publication No. 2000-328174

[Patent Document 6] Japanese Unexamined Patent Application, First Publication No. H7-216498

DISCLOSURE OF THE INVENTION

Problems to be Solved by the Invention

The present invention has been made in consideration of such circumstances, and an object thereof is to provide a high strength ultra thick H-section steel having a flange thickness of 100 mm or more and excellent toughness, and a method of producing the same.

The H-section steel of the present invention is not a build-up H-section steel which is formed by welding steel plates but a rolled and non-heat-treated H-section steel which is formed by hot rolling and does not require a tempering treatment.

Means for Solving the Problem

In order to ensure the strength in the vicinity of the surface of the steel, it is effective to form a low temperature transformation structure such as bainite by finishing rolling before the temperature of the vicinity of the surface reaches a transformation start temperature ($Ar_3$ point) and starting water cooling after the rolling. However, when an ultra thick H-section steel having a flange thickness of 100 mm or more is produced, a difference in temperature between the surface and the inside tends to increase in the rolling process.

The inventors examined the difference in temperature between the surface and the inside of the ultra thick H-section steel during rolling through a computer simulation. As a result, it was found that, for example, in a case where an H-section steel having a flange thickness of 125 mm is produced, the difference in temperature between the surface and the inside reaches as high as 200° C. In such a case, for example, even when rolling is finished at a temperature at which the surface of the steel is close to the ferrite transformation start temperature ($Ar_3$ point), the rolling finishing temperature of the inside of the steel is 1000° C. or higher. Therefore, austenite grains of the inside of the steel become coarser than in the surface, and the toughness tends to deteriorate.

In order to limit coarsening of austenite grains of the inside of the steel, it is effective to decrease a rolling temperature. However, the rolling temperature significantly decreases, formability during rolling is significantly deteriorated, and the temperature of a region close to the surface significantly decreases. When the temperature of the vicinity of the surface becomes too low, austenite grains are excessively refined. As a result, there is a problem in that the hardenability is deteriorated and the strength is decreased.

As described above, it is difficult to achieve the compatibility between ensuring of the strength of a region close to the surface of a steel and ensuring of the toughness of the inside of the steel only by using a method of controlling an austenite grain size through control of a rolling temperature, which is generally used.

As described above, in order to increase the toughness of an H-section steel, austenite grain refinement is preferable. On the other hand, excessive refinement of the austenite grain size is not preferable in terms of high-strengthening.

The inventors have newly found that an ultra thick H-section steel having excellent strength and toughness is obtained in a case where chemical components such as Si, Mn, V, and Ti and $C_{eq}$ are appropriately controlled, oxides containing Mg are then finely dispersed in a steel, and an austenite grain size is controlled by performing hot rolling on the steel at a high finishing temperature.

Specifically, it has been found that both the strength and toughness of an ultra thick H-section steel can be ensured when a region where the strength is to be evaluated is caused to have an austenite grain size of 70 μm or more by finely dispersing oxides containing Mg in a steel and then performing controlled rolling thereon, and a region where the toughness is to be evaluated is caused to have an average austenite grain size of 200 μm or less to perform cooling thereon. The inventors have found the ultra thick H-section steel having the above-described structure has a strength of 550 MPa or more and has toughness as high as an absorbed energy of 100 J or more in the Charpy impact test at a test temperature of 21° C.

There may be cases where the oxides containing Mg are included in TiN precipitates.

The gist of the present invention is as follows.

(1) According to an aspect of the present invention, an H-section steel includes, as a chemical composition, by mass %: C: 0.05% to 0.16%; Si: 0.01% to 0.50%; Mn: 0.70% to 2.00%; V: 0.01% to 0.20%; Al: 0.0001% to 0.10%; Ti: 0.003% to 0.030%; N: 0.0010% to 0.0200%; O: 0.0001% to 0.0100%; Mg: 0.0003% to 0.0050%; Ni: 0% to 0.50%; Cr: 0% to 0.50%; Cu: 0% to 0.50%; Mo: 0% to 0.30%; Nb: 0% to 0.010%; B: 0% to 0.0020%; Ca: 0% to 0.0050%; and a remainder of Fe and impurities, in which the carbon equivalent $C_{eq}$ obtained by the following Equation 1 is 0.30% to 0.50%, a Mg-containing oxide having an equivalent circle diameter of 0.005 μm to 0.5 μm at a total number density of 100 pieces/mm$^2$ to 5000 pieces/mm$^2$, the thickness of a flange is 100 mm to 150 mm, at a strength evaluation portion which is at a ⅙ position from a surface of the flange in a length direction and at a ¼ position from the surface in a thickness direction, the fraction of bainite in a steel structure is 80% or more, and the average prior austenite grain size is 70 μm or more, and at a toughness evaluation portion which is at a ½ position from the surface of the flange in the length direction and at a ¾ position from the surface of the flange in the thickness direction, the average prior austenite grain size in a steel structure is 200 μm or less.

$$C_{eq}=C+Mn/6+(Cr+Mo+V)/5+(Ni+Cu)/15 \quad \text{Equation (a)}$$

here, C, Mn, Cr Mo, V, Ni, and Cu represent the amount of each element contained by mass % and the amount of an element not contained is 0.

(2) In the H-section steel according to (1), the H-section steel may include, as the chemical composition, by mass %, one or more of Ni: 0.01% to 0.50%, Cr: 0.01% to 0.50%, Cu: 0.01% to 0.50%, Mo: 0.001% to 0.30%, Nb: 0.001% to 0.010%, B: 0.0001% to 0.0020%, and Ca: 0.0001% to 0.0050%.

(3) In the H-section steel according to (1) or (2), at the strength evaluation portion at room temperature, the yield strength or 0.2% proof stress may be 450 MPa or more, and a tensile strength may be 550 MPa or more, and at the toughness evaluation portion, the Charpy absorbed energy at a test temperature of 21° C. may be 100 J or more.

(4) According to another aspect of the present invention, a method of producing an H-section steel includes: a refining step which performs deoxidizing to cause a concentration of oxygen in a molten steel to be 0.0020% to 0.0100%, then sequentially adding Ti, Al, and Mg, and adjusting a chemical composition of the molten steel to include by mass %, C: 0.05% to 0.16%, Si: 0.01% to 0.50%, Mn: 0.70% to 2.00%, V: 0.01% to 0.20%, Al: 0.0001% to 0.10%, Ti: 0.003% to 0.030%, N: 0.0010% to 0.0200%, O: 0.0001% to 0.0100%, Mg: 0.0003% to 0.0050%, Ni: 0% to 0.50%, Cr: 0% to 0.50%, Cu: 0% to 0.50%, Mo: 0% to 0.30%, Nb: 0% to 0.010%, B: 0% to 0.0020%, Ca: 0% to 0.0050%, and a remainder of Fe and impurities, and to have a carbon equivalent $C_{eq}$ obtained by the following Equation b of 0.30% to 0.50%; a casting step which casts the molten steel to obtain a steel piece; a heating step which heats the steel piece to 1100° C. to 1350° C.; a hot-rolling step which performs rolling on the heated steel piece such that a surface temperature of 850° C. or higher when the rolling is finished, thereby obtaining the H-section steel; and a cooling step which performs water-cooling the H-section steel after the hot-rolling step, in which in the cooling step, water cooling conditions are controlled so that a cooling rate in a range from 800° C. to 600° C. at a ⅙ position from a surface of a flange in a length direction and at a ¼ position from the surface of the flange in a thickness direction is 2.2° C./s or more and the surface temperature after stopping the water cooling is recuperated within a temperature range of 300° C. to 700° C.

$$C_{eq}=C\ Mn/6+(Cr+Mo+V)/5+(Ni+Cu)/15 \qquad \text{Equation b}$$

here, C, Mn, Cr, Mo, V, Ni, and Cu represent the amount of each element contained by mass % and the amount of an element not contained is 0.

(5) In the method of producing an H-section steel according to (4), the H-section steel may include, as the chemical composition, by mass %, one or more of Ni: 0.01% to 0.50%, Cr: 0.01% to 0.50%, Cu: 0.01% to 0.50%, Mo: 0.001% to 0.30%, Nb: 0.001% to 0.010%, B: 0.0001% to 0.0020%, and Ca: 0.0001% to 0.0050%.

Effects of the Invention

According to the above aspects of the present invention, it is possible to obtain a high strength ultra thick H-section steel which has a flange thickness of 100 mm to 150 mm, and has excellent toughness. The high strength ultra thick H-section steel has a yield strength or 0.2% proof stress of 450 MPa or more, a tensile strength of 550 MPa or more, and a Charpy absorbed energy (toughness) at 21° C. of 100 J or more, and thus has both high strength and excellent toughness.

In addition, the high strength ultra thick H-section steel according to the present invention can be produced without adding a large amount of alloys or reducing carbon to the ultra low carbon level, which causes significant steel-making loads. Accordingly, this makes it possible to reduce production costs and shorten the production time, thereby achieving a significant reduction in costs. Therefore, according to the present invention, the reliability of large buildings can be improved without sacrificing cost efficiency, and hence, the present invention makes an extremely significant contribution to industries.

EMBODIMENTS OF THE INVENTION

Figure 1:
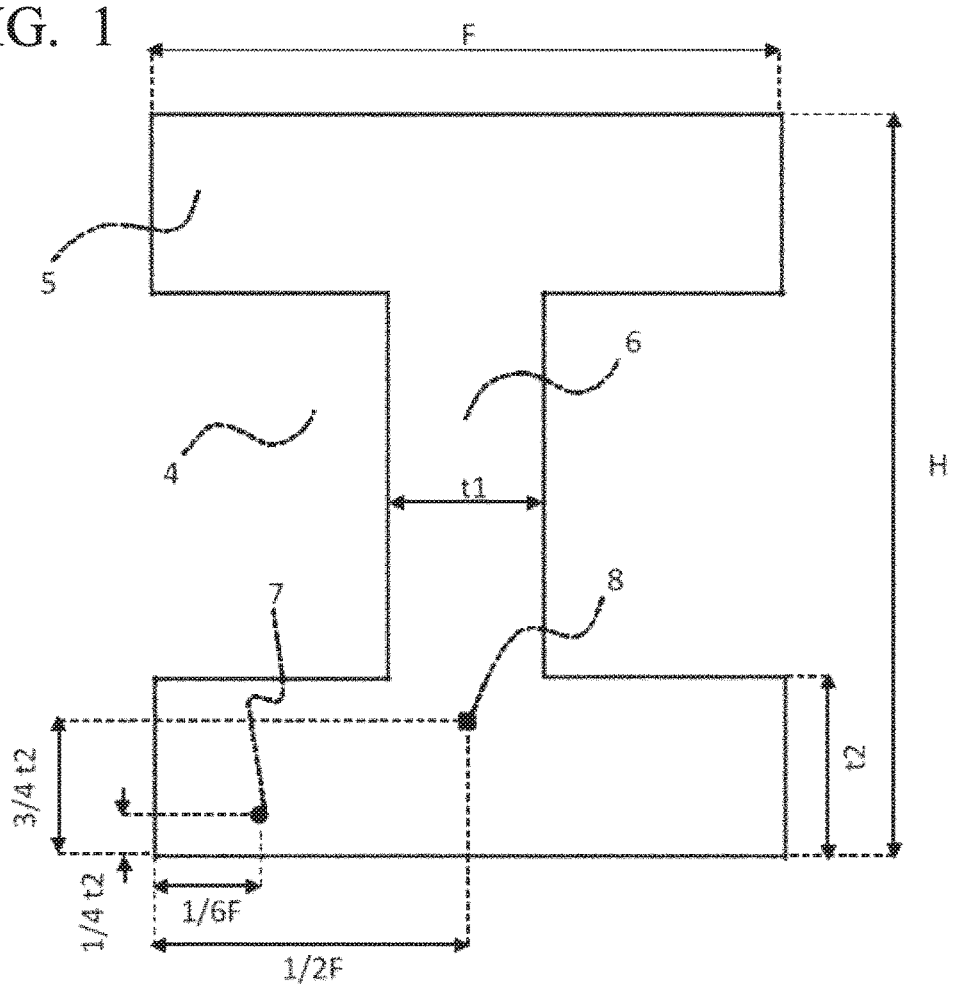
FIG. 1 is a view showing the sectional shape of an H-section steel and positions at which test pieces are extracted.

Hereinafter, an H-section steel according to an embodiment of the present invention (hereinafter, sometimes referred to as an H-section steel according to an embodiment) and a method of producing the same will be described. First, the reason for limiting the component range (chemical composition) of the H-section steel according to the embodiment will be described. Here, the symbol "%" of the components indicates mass %.

C: 0.05% to 0.16%

C is an element effective in high-strengthening of the steel. In order to obtain this effect, the lower limit value of the C content is set to 0.05%. The lower limit of the C content is preferably 0.08%. On the other hand, when the C content is more than 0.16%, the amount of generated carbides becomes excessive and toughness is deteriorated. Therefore, the upper limit of the C content is set to 0.16%. In order to further improve the toughness, the upper limit of the C content is preferably set to 0.13%.

Si: 0.01% to 0.50%

Si is a deoxidizing element and also contributes to improving the strength of the steel. In order to obtain these effects, the lower limit of the Si content is set to 0.01%, and preferably 0.10%. On the other hand, when the Si content is excessive, formation of martensite-austenite constituent (sometimes referred to as MA) is promoted and toughness is deteriorated. Therefore, the upper limit of the Si content is set to 0.50%. In a case of further improving the toughness, the upper limit of the Si content is preferably set to 0.40% and is more preferably set to 0.30%.

Mn: 0.70% to 2.00%

Mn promotes formation of bainite by increasing the hardenability of the steel and contributes to improving strength by limiting the formation of ferrite from prior austenite grain boundaries. In order to obtain these effects, the lower limit of the Mn content is set to 0.70%. In order to further increase the strength, the lower limit of the Mn content is preferably set to 1.00% and more preferably set to 1.30%. On the other hand, when the Mn content is more than 2.00%, formation of MA is promoted and toughness is deteriorated. Therefore, the upper limit of the Mn content is set to 2.00%. The upper limit of the Mn content is preferably 1.80% and is more preferably 1.60%.

V: 0.01% to 0.20%

V contributes to improving the hardenability of the steel. In addition, V forms carbonitrides in the steel, and contributes to refinement of the structure and precipitation strengthening. In order to obtain these effects, the lower limit of the V content is set to 0.01%. The lower limit of the V content is preferably 0.04%. On the other hand, when the V content is excessive, the precipitates are coarsened, possibly leading to a deterioration in toughness. Therefore, the upper limit of the V content is set to 0.20%. The upper limit of the V content is preferably 0.08%.

Al: 0.0001% to 0.10%

Al is a deoxidizing element. For the purpose of deoxidation, the lower limit value of the Al content is set to 0.0001%. On the other hand, there may be cases where Al is also contained in Mg-containing oxides. When the amount of Al in the steel is excessive, the Mg-containing oxides are coarsened. When the Mg-containing oxides are coarsened, the Mg-containing oxides become the origin of brittle fracture, and toughness is deteriorated. Therefore, the upper limit of the Al content is set to 0.10%. The upper limit of the Al content is preferably set to 0.050% and is more preferably set to 0.020%.

Ti: 0.003% to 0.030%

Ti is an element that binds to N and forms TiN. TiN has an effect of refining austenite using a pinning effect and an effect of precipitating to the periphery of the Mg-containing oxides and enhancing the pinning effect. Therefore, Ti is an effective element. In order to obtain these effects, the lower limit of the Ti content is set to 0.003%.

In addition, in a case where the steel contains B as well as Ti, Ti forms TiN and fixes N. When N is fixed as TiN, B in the steel becomes solid solution B, and thus the hardenability of the steel is increased. Therefore, in a case where the steel contains B, in order to ensure the amount of the solid solution B, it is preferable that the lower limit of the Ti content is set to 0.010%.

On the other hand, when the amount of Ti is more than 0.030%, coarse TiN is formed and toughness is deteriorated. Therefore, the upper limit of the Ti content is set to 0.030%. The upper limit of the Ti content is preferably set to 0.020%.

N: 0.0010% to 0.0200%

N binds to Ti or V to form TiN and VN and is an element contributing to the refinement of the structure and precipitation strengthening. In order to obtain these effects, the lower limit of the N content is set to 0.0010%. On the other hand, when the N content is excessive, the toughness of a base metal is deteriorated, and material defects are incurred by surface cracking during casting and strain aging of the produced steel. Therefore, the upper limit of the N content is preferably set to 0.0200%. The upper limit of the N content is preferably set to 0.0100%.

O: 0.0001% to 0.0100%

O forms oxides containing Mg, is an element necessary for refinement of austenite by the pinning effect, and is a particularly important element in the H-section steel according to the embodiment. In order to obtain these effects, the lower limit of the O content needs to be set to 0.0001%. The lower limit of the O content is preferably 0.0005%. On the other hand, when the O content is excessive, the toughness is deteriorated due to an effect of solid solution O or coarsening of oxide particles. Therefore, the upper limit of the O content is set to 0.0100%. The upper limit of the O content is preferably set to 0.0050%.

Mg: 0.0003% to 0.0050%

Mg forms oxides, is an element necessary for refinement of austenite by the pinning effect, and is a particularly important element in the H-section steel according to the embodiment. In order to obtain these effects, the lower limit of the Mg content needs to be set to 0.0003%. The lower limit of the Mg content is preferably 0.0005%, and the lower limit of the Mg content is more preferably 0.0010%. On the other hand, when the Mg content is excessive, toughness is deteriorated due to coarsening of oxide particles. Therefore, the upper limit of the Mg content is set to 0.0050%. The upper limit of the Mg content is preferably set to 0.0040%.

P and S are impurities and the amounts thereof are not particularly limited. However, P and S cause weld cracking and a deterioration in toughness due to solidifying segregation, and thus the amounts thereof are preferably as low as possible. The P content is preferably limited to 0.03% or less and more preferably limited to 0.01% or less. In addition, the S content is preferably limited to 0.02% or less.

The H-section steel according to the embodiment basically contains the above-described chemical components and a remainder consisting of Fe and impurities. However, in order to further enhance strength and toughness, the steel may contain, instead of a portion of Fe, one of or two or more of Ni, Cr, Cu, Mo, Nb, B, and Ca within the following ranges. These elements are not necessarily contained in the steel. Therefore, all of the lower limits of these elements are 0%.

Here, the impurities indicate those impurities that are mixed from raw materials such as ore and scrap or by the other factors when the steel is industrially produced.

Ni: 0.01% to 0.50%

Ni is a significantly effective element for increasing the strength and toughness of the steel. In order to increase the strength, the Ni content is preferably set to 0.01% or more. In addition, in order to increase the toughness, the Ni content is preferably set to 0.10% or more. On the other hand, when the Ni content is more than 0.50%, alloying costs are significantly increased. Thus, the upper limit of the Ni content is preferably set to 0.50% even in a case where Ni is contained. The upper limit of the Ni content is more preferably 0.30%.

Cr: 0.01% to 0.50%

Cr is an element that improves the hardenability of the steel and contributes to improving the strength. In order to improve the hardenability, the Cr content is preferably set to 0.01% or more and more preferably 0.10% or more. On the other hand, when the Cr content is more than 0.50%, formation of MA is promoted and Cr carbides are coarsened, possibly deteriorating the toughness. Therefore, the upper limit of the Cr content is preferably set to 0.50% even in a case where Cr is contained. The upper limit of the amount of Cr is more preferably 0.30%.

Cu: 0.01% to 0.50%

Cu is an element that contributes to high-strengthening of the steel by hardenability improvement and/or precipitation strengthening. In a case of obtaining these effects, the Cu content is preferably set to 0.01% or more, and more preferably 0.10% or more. On the other hand, when the Cu content is excessive, formation of MA is promoted and the strength becomes excessive, possibly deteriorating toughness. Therefore, the upper limit of the Cu content is preferably set to 0.50% even in a case where Cu is contained. The upper limit of the Cu content is more preferably 0.30%, and the upper limit thereof is still more preferably 0.20%.

Mo: 0.001% to 0.30%

Mo is an element that is solid-solute in the steel and thus improves the hardenability, and contributes to improving the strength. Particularly, in a case where B is contained with Mo, the synergy effect of B and Mo regarding the hardenability is significant. In a case of obtaining these effects, the Mo content is preferably set to 0.001% or more, and more preferably 0.01% or more. On the other hand, when the Mo content is more than 0.30%, formation of MA is promoted, possibly deteriorating toughness. Therefore, the upper limit of the Mo content is preferably set to 0.30% even in a case where Mo is contained.

Nb: 0.001% to 0.010%

Nb is an element that increases hardenability like Mo and contributes to increasing strength. In order to obtain the effect of increasing the strength, the Nb content is preferably set to 0.001% or more and more preferably 0.003% or more. On the other hand, when the Nb content is excessive, Nb carbides are formed and toughness may be deteriorated. Therefore, the upper limit of the Nb content is preferably set to 0.010% even in a case where Nb is contained. The upper limit of the Nb content is more preferably 0.007%.

B: 0.0001% to 0.0020%

B is an element that significantly increases the hardenability of the steel with very small amount of addition and is effective in limiting ferrite transformation from austenite grain boundaries and increasing strength. In order to obtain these effects, the B content is preferably set to 0.0001% or more, and is more preferably 0.0003% or more and still more preferably 0.0010%. On the other hand, when the B content is more than 0.0020%, formation of MA is promoted, possibly deteriorating toughness. Therefore, even in a case where B is contained, the upper limit of the B content is preferably set to 0.0020%, and still more preferably set to 0.0015%.

Ca: 0.0001% to 0.0050%

Ca increases the thermal stability of the Mg-containing oxides when contained in the Mg-containing oxides and has an effect of bringing refinement of the Mg-containing oxide and an increase in the number density thereof. In a case of obtaining these effects, the Ca content is preferably set to 0.0001% or more, and is more preferably 0.0010% or more. On the other hand, when the Ca content is more than 0.0050%, the oxides are coarsened and become the origin of brittle fracture, possibly deteriorating toughness. Therefore, even in a case where Ca is contained, the upper limit of the Ca content is preferably set to 0.0050% and is more preferably set to 0.0030%.

$C_{eq}$: 0.30% to 0.50%

In the H-section steel according to the embodiment, in order to increase hardenability and form bainite, in addition to each of the chemical components specified as above, the carbon equivalent $C_{eq}$ obtained by the following Equation (1) needs to be set to 0.30% to 0.50%. When the $C_{eq}$ is less than 0.30%, bainite is not sufficiently formed, which results in a deterioration in the strength. Therefore, the lower limit of the $C_{eq}$ is set to 0.30%. The lower limit of the $C_{eq}$ is preferably 0.35%. On the other hand, when the $C_{eq}$ is more than 0.50%, the strength is excessively increased and the toughness is deteriorated. Therefore, the upper limit of the $C_{eq}$ is set to 0.50%. The upper limit of the $C_{eq}$ is preferably 0.45%, and the upper limit of the $C_{eq}$ is more preferably 0.43%.

The $C_{eq}$ is a carbon equivalent as an index of hardenability and is obtained by the following Equation (1). Here, C, Mn, Cr, Mo, V, Ni, and Cu in the equation represent the amounts of the corresponding elements contained in the steel by mass %. The amount of the elements which are not contained is set to 0.

$$C_{eq}=C+Mn/6+(Cr+Mo+V)/5+(Ni+Cu)/15 \quad \text{Equation (1)}$$

Next, the microstructure of the H-section steel according to the embodiment will be described.

In the H-section steel according to the embodiment, oxides containing Mg (Mg-containing oxides) with an equivalent circle diameter of 0.005 μm to 0.5 μm is contained in the steel at a total number density of 100 pieces/$mm^2$ to 5000 pieces/$mm^2$. In addition, at a ⅙ position from the surface of the flange in a length direction and at a ¼ position from the surface in a thickness direction, the fraction of bainite in the steel structure is 80% or more, and an average prior austenite grain size is 70 μm or more. Further, at a ½ position from the surface of the flange in the length direction and at a ¾ position from the surface in the thickness direction, the average prior austenite grain size in the steel structure is 200 μm or less.

The reason for specifying the fraction of bainite and the austenite grain size at the ⅙ position from the surface of the flange in the length direction and at the ¼ position from the surface in the thickness direction will be described.

In the H-section steel according to the embodiment, a portion which is at the ⅙ position from the surface of the flange in the length direction and at the ¼ position from the surface in the thickness direction is considered to obtain an average structure. Therefore, this portion is defined as a strength evaluation portion, a sample is taken from this portion, and the observation of the microstructure and the measurement of the fraction of bainite are performed, thereby evaluating the strength of the H-section steel. As shown in FIG. 1, the strength evaluation portion 7 is a portion that is at the ⅙ position from the surface of the flange in the length direction and at the ¼ position from the surface in the thickness direction.

In order to ensure the strength, it is necessary that at the strength evaluation portion 7, the average austenite grain size (prior austenite grain size) is 70 μm or more, and the steel structure includes bainite with a fraction (area fraction) of 80% or more.

When the average austenite grain size is less than 70 μm, the hardenability is deteriorated, and the fraction of bainite decreases. When the fraction of bainite is less than 80%, sufficient strength cannot be obtained. The remainder of the structure includes one or two or more of ferrite, pearlite, and MA. Since an increase in the fraction of bainite contributes to improving the strength, the upper limit of the fraction of bainite is not defined and may be 100%.

The microstructure of the steel can be determined by observation with an optical microscope. For example, the fraction (area fraction) of each structure in the microstructure can be calculated as a ratio of the number of grains in each structure by arranging measurement points in a lattice shape in which one side is 50 μm and distinguishing the structures with 400 measurement points using a structure image photographed at a magnification of 200 times using an optical microscope.

Next, the reason for specifying the prior austenite grain size at the ½ position from the surface of the flange in the length direction and at the ¾ position from the surface in the thickness direction will be described.

As described above, since the rolling finishing temperature in a portion far from the surface, such as the thickness center portion of the flange or the fillet, is high, the austenite grains are likely to be coarsened. That is, in a case of an ultra thick H-section steel, the rolling finishing temperature in a portion near the surface decreases, and the austenite grains are refined. On the other hand, the rolling finishing temperature of the inside increases, and the austenite grains are coarsened.

In the H-section steel according to the embodiment, a portion at the ½ position from the surface of the flange in the length direction and at the ¾ position from the surface in the thickness direction is considered to have the lowest toughness. Therefore, this portion is defined as a toughness evaluation portion, the microstructure at this same portion is observed to evaluate the grain size of prior austenite, and a sample is taken from the same portion to evaluate the toughness. As shown in FIG. 1, the toughness evaluation portion 8 is at the ½ position from the surface of the flange in the length direction and at the ¾ position from the surface in the thickness direction.

The inventors observed the microstructure at the toughness evaluation portion 8, evaluated the prior austenite grain size, and have found that in order to ensure toughness, it is necessary to control an austenite grain size 200 μm or less. The lower limit of the prior austenite grain size at the toughness evaluation portion 8 does not need to be limited. However, it is difficult to cause the average prior austenite grain size of the toughness evaluation portion to be lower than the average prior austenite grain size of the strength evaluation portion, and thus the lower limit thereof may be set to 70 μm.

The average prior austenite grain size at the strength evaluation portion and the toughness evaluation portion is measured using a structure image obtained using an optical microscope at a magnification of 50 times or an electron backscatter diffraction pattern (EBSP) observation image measured at a magnification of 70 times. Specifically, the average prior austenite grain size is measured by counting, using an optical microscope photograph or an EBSP observation image with a visual filed of 1 mm square or greater, the number of prior austenite grains in the visual field, dividing the area of the visual field by the number, calculating the area of each prior austenite grain size, and converting the area into the diameter of a circle having the same area. The number of prior austenite grains on the visual field boundary is counted as 0.5.

Next, the sizes and dispersed state of the oxides containing Mg (Mg-containing oxides), which are present in the H-section steel according to the embodiment, will be described.

In the embodiment, the Mg-containing oxides are oxides that primarily contain Mg, and include those included in TiN precipitates. The Mg-containing oxides included in the TiN precipitates indicate a state TiN is precipitated to the periphery of oxides containing Mg. That is, when a Mg-containing oxide is observed using a transmission electron microscope (TEM), there may be a case where the Mg-containing oxide is singly observed and a case where TiN precipitates are observed in the vicinity of the Mg-containing oxide. In addition, the Mg-containing oxide in the embodiment may also contain Al.

As described above, the prior austenite grain size at the strength evaluation portion is preferably as large as possible in order to ensure hardenability, and the prior austenite grain size at the toughness evaluation portion is preferably as small as possible in order to enhance toughness. However, the austenite grain size at the toughness evaluation portion having a high rolling finishing temperature than that in the strength evaluation portion is likely to be coarsened, and it is difficult to decrease the prior austenite grain size at the toughness evaluation portion while increasing the prior austenite grain size at the strength evaluation portion. That is, it is a difficult task to achieve both of ensuring of the strength of the strength evaluation portion and ensuring of the toughness of the toughness evaluation portion.

The inventors have found that in a case where an ultra thick H-section steel is produced by rolling a steel piece that does not contain austenite grains as pinning particles, the austenite grain sizes of the strength evaluation portion and the toughness evaluation portion are determined by the effect of rolling recrystallization depending on rolling conditions. In addition, in order to enable the average prior austenite grain size of the strength evaluation portion to be as large as 70 μm or more, the rolling finishing temperature (the temperature at the time when hot rolling is finished) in terms of surface temperature has to be increased to 850° C. or higher. However, under these conditions, the average prior austenite grain size of the toughness evaluation portion reaches 300 μm or more and it has been found that the toughness of the toughness evaluation portion is insufficient.

In order to solve the problems, the inventors have conducted an investigation on a method of reducing the prior austenite grain size of the toughness evaluation portion without excessively refining the prior austenite grain size of the strength evaluation portion by appropriately dispersing Mg-containing oxides in the steel and optimizing rolling conditions.

Specifically, the inventors have conducted an investigation on a method of causing the average grain size of prior austenite grains of the strength evaluation portion to be 70 μm or more and causing the average grain size of prior austenite grains of the toughness evaluation portion to be 200 μm or less by appropriately dispersing Mg-containing oxides as pinning particles in the steel piece and rolling the steel piece at a high rolling temperature. As a result, it has been clarified by an experiment and analysis that the refining effect by rolling recrystallization at the strength evaluation portion 7 is stronger than the pinning effect and the austenite grain size thereof is determined substantially by the effect of rolling recrystallization while the refining effect by pinning at the toughness evaluation portion 8 is stronger than the effect of rolling recrystallization and the austenite grain size thereof is determined by the pinning effect.

In order to ensure the strength at the strength evaluation portion 7, it is necessary that the average prior austenite grain is 70 μm or more. As the prior austenite grain size increases, the hardenability increases, and the strength increases. Therefore, the upper limit thereof does not need to be specified. However, it is thought that the prior austenite grain size of the strength evaluation portion becomes smaller than the prior austenite grain size of the toughness evaluation portion. Therefore, the upper limit of the average prior austenite grain size of the strength evaluation portion may be set to 200 μm, or may also be set to 150 μm.

In order to ensure the toughness at the toughness evaluation portion 8, it is necessary that the average grain size of prior austenite grains is 200 μm or less. The inventors have conducted an investigation on the effect of the size and number density of the Mg-containing oxides in order to realize the pinning effect in an appropriate range. As a result, it has been found by an experiment that it is necessary that oxides containing Mg have a size of 0.005 μm to 0.5 μm in terms of equivalent circle diameter and are present at a total number density of 100 pieces/$mm^2$ or more and 5000 pieces/$mm^2$ or less. When the number density thereof is less than 100 pieces/$mm^2$, a sufficient pinning effect cannot be obtained at the toughness evaluation portion. On the other hand, when the number density thereof is more than 5000 pieces/$mm^2$, the pinning effect becomes too strong, and the strength evaluation portion as well as the toughness evaluation portion is excessively refined, possibly deteriorating the strength.

In addition, while there is no effect even if the size of the Mg-containing oxides is small, it becomes difficult to observe the oxides with a transmission electron microscope when the size is decreased to less than 0.005 μm in terms of equivalent circle diameter. Therefore, the lower limit of the equivalent circle diameter of the Mg-containing oxides specified in the H-section steel according to the embodiment is set to 0.005 μm. On the other hand, it is thought that the number of Mg-containing oxides having a size of greater than 0.5 μm in terms of equivalent circle diameter is low and this has a small effect. Therefore, the upper limit thereof is set to 0.5 μm. However, oxides of 0.5 μm or more become the origin of brittle fracture. In addition, when the number of the oxides of 0.5 μm or more increases, a predetermined number of Mg-containing oxides of 0.005 μm to 0.5 μm, which are effective in pinning, cannot be ensured. Therefore, the number density of oxides of 0.5 μm or more is preferably 50 pieces/$mm^2$ or more.

Although the Mg-containing oxides are uniformly dispersed in the steel, the number density thereof at the toughness evaluation portion in the H-section steel according to the present invention is particularly important. Therefore, in the embodiment, the number density of the Mg-containing oxides is calculated by sampling an extraction replica from the position of the toughness evaluation portion of the produced H-section steel and observing the sample with an electron microscope. The composition of the oxides is identified using an energy-dispersive X-ray spectrometer (EDS) attached to the electron microscope.

Next, the shape and mechanical properties of the H-section steel according to the embodiment will be described.

The thickness of the flange of the H-section steel according to the embodiment is set to 100 mm to 150 mm. This is because a strength member having a flange thickness of 100 mm or more is required as an H-section steel, for example, used for high-rise building structures. On the other hand, when the thickness of the flange is more than 150 mm, a sufficient cooling rate cannot be obtained and it is difficult to simultaneously ensure the strength and toughness. Thus, the upper limit thereof is set to 150 mm. Although the thickness of the web of the H-section steel is not particularly defined, the thickness is preferably 50 mm to 150 mm.

The thickness ratio between the flange and the web (thickness ratio expressed by flange/web) is preferably set to 0.5 to 2.0 on the assumption that the H-section steel is produced by hot rolling. When the thickness ratio between the flange and the web is more than 2.0, the web may be deformed into a wavy shape. On the other hand, in a case where the thickness ratio between the flange and the web is less than 0.5, the flange may be deformed into a wavy shape.

For the mechanical properties of the H-section steel according to the present invention, the yield strength or 0.2% proof stress at normal temperatures is 450 MPa or more; and the tensile strength is 550 MPa or more. Further, the Charpy absorbed energy at 21° C. is 100 J or more. The excessively high strength possibly causes a deterioration in toughness. Thus, it is preferable to set the yield strength or 0.2% proof stress at normal temperatures to 550 MPa or less, and set the tensile strength to 680 MPa or less.

Next, a preferred method of producing the H-section steel according to this embodiment will be described.

In order to control the composition, number, and size of the Mg-containing oxides to predetermined conditions, a deoxidizing method is important in a steel-making process. In the method of producing the H-section steel according to the embodiment, after tapping off a steel from a converter, the concentration of dissolved oxygen therein is adjusted so as to fall within a range of 0.0020% to 0.0100% by primary deoxidation. Thereafter, Ti, Al, and Mg are added thereto in this order (the order of Ti, Al, and Mg). In addition, the chemical composition of the molten steel is then adjusted so as to fall within the above-described range (refining process).

When the concentration of dissolved oxygen before Ti is added is less than 0.0020%, Mg is likely to form sulfides (MgS) other than oxides, and Mg-containing oxides having a predetermined equivalent circle diameter cannot be sufficiently obtained. When the concentration of dissolved oxygen is more than 0.0100%, the Mg-containing oxides are excessively coarsened or a large amount of dissolved oxygen remains in the steel, resulting in a significant deterioration in toughness.

In addition, when Ti, Al, and Mg are not added in this order, Mg-containing oxides having a predetermined size and number density cannot be obtained. For example, when Mg is added firstly among Ti, Al, and Mg, Mg strongly binds to oxygen and becomes coarse, such that fine oxides cannot be obtained even when Ti and Al are added thereafter. Therefore, it is necessary that these elements are added to the molten steel in the order of Ti, Al, and Mg, which is the ascending order of deoxidizing force. When the elements are added in this order, oxygen atoms in the molten steel are repeatedly separated from and bonded to Ti, Al, and Mg such that coarsening of oxides is limited. Finally, fine oxides containing Mg are obtained.

When Ti, Al, and Mg are added in this order, Al and Mg are added after 1 minute or longer has passed from the addition of the previous element. The reason is that a time for uniformly dispersing Ti, Al, and Mg in the molten steel has to be ensured.

Next, the molten steel is cast to obtain steel pieces (casting step). As for the casting, from the viewpoint of productivity, continuous casting is preferable. However, the steel may be cast into a beam blank having a shape close to the shape of an H-section steel to be produced. Further, the thickness of the steel piece is preferably set to 200 mm or more from the viewpoint of productivity and is preferably 350 mm or less in consideration of segregation reduction and heating temperature uniformity in hot rolling.

In a case where the H-section steel is produced using continuous cast slabs, the toughness evaluation portion corresponds to the position of the center segregation of the slab, and a treatment for reducing the center segregation is preferably performed in order to further limit a deterioration in toughness. The center segregation may be reduced by light rolling reduction during continuous casting or a homogenization heat treatment.

Next, the steel pieces are heated (heating step), and hot rolling is performed on the heated steel pieces (hot rolling step). When the heating temperature of the steel piece is lower than 1100° C., deformation resistance during finish rolling increases. Thus, the heating temperature is set to 1100° C. or higher. In order to sufficiently solid-solute elements, such as Ti and Nb, for forming carbides and nitrides, the heating temperature is preferably set to 1150° C. or higher. On the other hand, when the heating temperature is higher than 1350° C., scale on the surface of the steel piece, which is a raw material, is liquefied and causes difficulties during production. Thus, the upper limit of the heating temperature of the steel piece is set to 1350° C.

As described above, in the H-section steel according to the embodiment, while the austenite grain size of the toughness evaluation portion 8 is primarily determined by the pinning effect of oxide particles, the austenite grain size of the strength evaluation portion is primarily determined by the rolling temperature. Therefore, in order to ensure the strength at the strength evaluation portion, the rolling temperature is preferably high.

In order to ensure strength by improving hardenability, it is necessary that the average austenite grain size of the strength evaluation portion is set to 70 μm or more, and in order to enable the average austenite grain size to be 70 μm or more, the rolling finishing temperature at the surface of the steel is set to 850° C. or higher.

In the hot rolling step, a process of performing primary rolling on steel, cooling the steel to 500° C. or lower, then reheating the steel to 1100° C. to 1350° C., and performing secondary rolling on the steel, that is, so-called two-heat rolling may be employed. With the two-heat rolling, there is little plastic deformation in the hot rolling and the drop in temperature in the rolling process also becomes smaller, and thus, the second heating temperature can be lowered.

After the hot rolling step, in order to obtain high strength, the flange and the web are water-cooled (cooling step). The water cooling can be performed by water spray with a spray or water immersion cooling in a water tank.

When accelerated cooling is performed by water cooling, formation of ferrite that is transformed from austenite grain boundaries is limited, and the fraction of bainite at the ⅙ position from the surface of the flange in the length direction and at the ¼ position from the surface in the thickness direction reaches 80% or more, thereby ensuring the strength.

In the cooling step, it is necessary to perform water cooling such that a cooling rate from 800° C. to 600° C. is 2.2° C./s or more at the ⅙ position from the surface of the flange in the length direction and at the ¼ position from the surface in the thickness direction (strength evaluation portion). When the cooling rate at the strength evaluation portion is less than 2.2° C./s, the desired hardened structure cannot be obtained. In order to ensure the strength, the cooling rate is preferably as high as possible. Thus, it is not necessary that the upper limit is not particularly limited. However, the upper limit of a typical cooling rate during water cooling for an ultra thick material is 20° C./s, and thus the upper limit may be set to 20° C./s.

In addition, regarding the water cooling, it is necessary that water cooling conditions are controlled such that the surface temperature after stopping the water cooling is recuperated within a temperature range of 300° C. to 700° C. When the recuperation temperature is lower than 300° C., self annealing is not sufficient and the toughness is deteriorated. On the other hand, when the recuperation temperature is higher than 700° C., the annealing temperature is excessively increased in the strength evaluation portion 7 or even near the surface of the entire steel, possibly decreasing the strength.

In the ultra thick H-section steel, a difference in cooling rate between the surface and the inside of the ultra thick H-section steel is large and it is difficult to control the surface temperature. That is, the surface temperature can be cooled to 200° C. or lower in a short period of time after the cooling is started. However, the inside cooling rate is low and thus the inside temperature is decreased depending on the water cooling time even after the surface temperature decreases. Therefore, the inside temperature cannot be evaluated by the surface temperature. Therefore, in the embodiment, the inside temperature is controlled and managed by the water cooling time or the water cooling start temperature. When the relationship between the cooling rate, the cooling time, and the recuperation temperature is measured in advance, the cooling rate and the recuperation temperature of the strength evaluation portion 7 and the toughness evaluation portion 8 can be controlled.

EXAMPLES

The steel was melted to produce steel pieces having a thickness of 240 mm to 300 mm by continuous casting. The steel was melted in a converter and primary deoxidation was performed. Alloys were added to adjust the components and vacuum degassing treatment was then performed as required. When Mg was added, as shown in Table 1, Ti, Al, and Mg were added after the concentration of dissolved oxygen was adjusted by the primary deoxidation. In the addition order of Table 1, for example, Ti→Al→Mg indicates that Ti, Al, and Mg were added in this order, and in each addition process, 1 minute or longer had passed from the addition of the previous element. On the other hand, Ti→Al+Mg indicates that after the addition of Ti, Al and Mg were substantially simultaneously added (the interval between the addition processes was shorter than 1 minute).

The steel pieces thus obtained were subjected to heating and hot rolling, thereby producing an H-section steel. The components shown in Table 1 were results obtained by chemically analyzing samples taken from the H-section steel after being produced.

Figure 2:
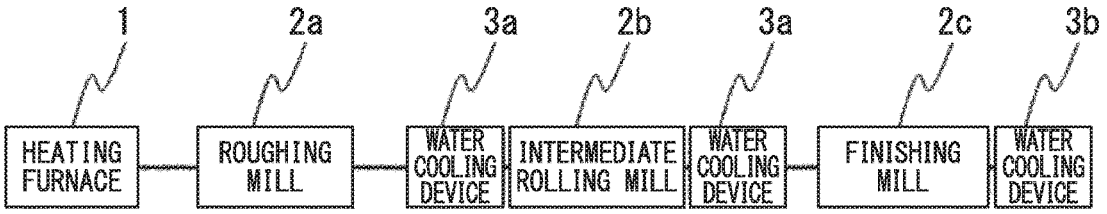
FIG. 2 is a diagram showing an example of a production apparatus for an H-section steel according to an embodiment of the present invention.

A production process of the H-section steel is shown in FIG. 2. The steel piece heated using a heating furnace 1 was rolled by a series of universal rolling apparatuses including a roughing mill 2*a*, an intermediate rolling mill 2*b*, and a finishing mill 2*c*, was subjected to finish rolling by the universal finishing mill (finishing mill) 2*c*, and thereafter water-cooled by a cooling device (water cooling devices) 3*b* provided on the rear surface.

Here, in a case where interpasswater cooling rolling was performed as the hot rolling, water cooling between rolling passes was performed by water-cooling the surfaces on the external side of the flange with spray cooling while performing reverse rolling using water cooling devices 3*a* provided on the front and rear surfaces of the universal intermediate rolling mill (intermediate rolling mill) 2*b*.

The production conditions including the heating temperature of the steel pieces, hot rolling, and accelerated cooling during production are shown in Table 2. The cooling rate in Table 2 is a cooling rate at the ⅙ position from the surface of the flange in the length direction and at the ¼ position from the surface in the thickness direction. However, the cooling rate is not measured directly and is a value calculated from a result of the measurement by attaching a thermocouple to corresponding portion at the measurement through heating with the same size separately performed in an off-line manner and based on the prediction through a computer simulation, and a water cooling start temperature, a water cooling stop temperature, and an application time.

In the produced H-section steel, a test piece for a tensile test, and samples used for measurement of prior austenite grain sizes and the structure fractions were taken from the strength evaluation portion 7 shown in FIG. 1. Using the test piece for a tensile test, the yield strength and the tensile strength were evaluated, and using the samples for measurement, the prior austenite grain size and the fraction of bainite were measured.

In addition, a test piece for a Charpy test and a sample used for structure observation were taken from the toughness evaluation portion 8 shown in FIG. 1. Using the test piece for a Charpy test, the toughness was evaluated, and using the sample for measurement, the prior austenite grain size was measured. In FIG. 1, $t_1$ represents a web thickness, $t_2$ represents a flange thickness, F represents a flange length, and H represents a height.

The tensile test was performed according to JIS Z 2241. In a case where the test piece showed yielding behavior, the yield point was obtained as YS. In a case where the test piece did not show yielding behavior, the 0.2% proof stress was obtained as YS. The Charpy impact test was performed at a test temperature of 21° C. according to JIS Z 2242.

In addition, the prior austenite grain size and the fraction of the structure were measured by observing the microstructure with an optical microscope or an EBSP. The fraction (area fraction) of each structure in the microstructure was calculated as a ratio of the number of grains in each structure by arranging measurement points in a lattice shape in which one side is 50 μm and distinguishing the structures with 400 measurement points using a structure image photographed at a magnification of 200 times using an optical microscope. The average prior austenite grain size was measured by counting, using an optical microscope photograph or an EBSP observation image with a visual filed of 1 mm square or greater, the number of prior austenite grains in the visual field, dividing the area of the visual field by the number, calculating the area of each prior austenite grain size, and converting the area into the diameter of a circle having the same area. The number of prior austenite grains on the visual field boundary was counted as 0.5.

Further, an extraction replica was produced from the toughness evaluation portion 8, the composition of oxides and precipitates was checked by an electron microscope or EDS, and the number density of Mg-containing oxides having an equivalent circle diameter of 0.005 μm to 0.5 μm was obtained. The Mg-containing oxides included TiN precipitates including Mg-containing oxides.

The number density of the Mg-containing oxide, the yield strength (YS), the tensile strength (TS), the prior austenite grain size (prior γ grain size), and the fraction of bainite of the strength evaluation portion, and the Charpy absorbed energy ($vE_{21}$) at 21° C. and the prior austenite grain size (prior γ grain size) of the toughness evaluation portion are shown in Table 3. The target values of the mechanical properties are set as follows: the yield strength or 0.2% proof stress (YS) at normal temperatures is set to 450 MPa or more; and the tensile strength (TS) is set to 550 MPa or more. Further, the Charpy absorbed energy ($vE_{21}$) at 21° C. is set to 100 J or more.

As shown in Table 3, in each of Production Nos. 1 to 5, Production Nos. 10 to 15, and Production Nos. 20 to 25, which are examples of the present invention, the YS and the TS respectively satisfied the target values of 450 MPa or more and 550 MPa or more. Further, the Charpy absorbed energy ($vE_{21}$) at 21° C. was 100 J or more and sufficiently satisfied the target. On the other hand, in each of Production Nos. 6 to 9, Production Nos. 16 to 19, and Production Nos. 26 to 37 in Table 3, one or more of the chemical composition, the production method, the fraction of bainite of the strength evaluation portion, the austenite grain size of the strength evaluation portion, the austenite grain size of the toughness evaluation portion, and the density of the Mg-containing oxide were outside of the ranges of the present invention. Therefore, one or more of the YS, the TS, and the Charpy absorbed energy at 21° C. did not satisfy the targets.

TABLE 1

| Component No. | Addition order | Concentration of dissolved oxygen before addition of Ti [%] | Chemical composition (mass %) C | Si | Mn | V | Al | Ti | N | O |
|---|---|---|---|---|---|---|---|---|---|---|
| 1 | Ti→Al→Mg | 0.0040 | 0.158 | 0.18 | 1.60 | 0.010 | 0.0050 | 0.010 | 0.0031 | 0.0021 |
| 2 | Ti→Al→Mg | 0.0022 | 0.139 | 0.39 | 1.80 | 0.031 | 0.0003 | 0.027 | 0.0072 | 0.0005 |
| 3 | Ti→Al→Mg | 0.0069 | 0.140 | 0.30 | 1.55 | 0.088 | 0.0527 | 0.009 | 0.0040 | 0.0039 |
| 4 | Ti→Al→Mg | 0.0033 | 0.119 | 0.45 | 1.95 | 0.055 | 0.0311 | 0.012 | 0.0029 | 0.0017 |
| 5 | Ti→Al→Mg | 0.0098 | 0.118 | 0.26 | 1.57 | 0.137 | 0.0920 | 0.011 | 0.0125 | 0.0081 |
| 6 | Ti→Al→Mg | 0.0035 | 0.119 | 0.30 | 1.53 | 0.058 | 0.0308 | 0.011 | 0.0030 | 0.0020 |
| 7 | Ti→Al→Mg | 0.0077 | 0.100 | 0.32 | 0.73 | 0.155 | 0.0090 | 0.015 | 0.0028 | 0.0062 |
| 8 | Ti→Al→Mg | 0.0028 | 0.099 | 0.21 | 0.99 | 0.080 | 0.0704 | 0.021 | 0.0150 | 0.0019 |
| 9 | Ti→Al→Mg | 0.0020 | 0.091 | 0.30 | 1.50 | 0.056 | 0.0031 | 0.014 | 0.0029 | 0.0015 |
| 10 | Ti→Al→Mg | 0.0031 | 0.090 | 0.30 | 1.51 | 0.057 | 0.0010 | 0.011 | 0.0027 | 0.0019 |
| 11 | Ti→Al→Mg | 0.0084 | 0.089 | 0.03 | 1.59 | 0.055 | 0.0029 | 0.003 | 0.0079 | 0.0066 |
| 12 | Ti→Al→Mg | 0.0042 | 0.089 | 0.15 | 1.32 | 0.020 | 0.0007 | 0.008 | 0.0030 | 0.0031 |
| 13 | Ti→Al→Mg | 0.0038 | 0.079 | 0.36 | 1.52 | 0.049 | 0.0258 | 0.012 | 0.0092 | 0.0022 |
| 14 | Ti→Al→Mg | 0.0026 | 0.080 | 0.24 | 1.55 | 0.082 | 0.0085 | 0.009 | 0.0041 | 0.0017 |
| 15 | Ti→Al→Mg | 0.0022 | 0.062 | 0.30 | 1.60 | 0.058 | 0.0066 | 0.012 | 0.0037 | 0.0016 |
| 16 | Ti→Al→Mg | 0.0021 | 0.061 | 0.28 | 1.79 | 0.077 | 0.0102 | 0.010 | 0.0027 | 0.0004 |
| 17 | Ti→Al→Mg | 0.0030 | 0.050 | 0.30 | 1.80 | 0.079 | 0.0198 | 0.009 | 0.0025 | 0.0010 |
| 18 | Ti→Al→Mg | 0.0023 | 0.198 | 0.33 | 1.55 | 0.048 | 0.0322 | 0.011 | 0.0044 | 0.0009 |
| 19 | Ti→Al→Mg | 0.0044 | 0.032 | 0.47 | 1.30 | 0.026 | 0.0308 | 0.014 | 0.0023 | 0.0022 |
| 20 | Ti→Al→Mg | 0.0032 | 0.102 | 0.75 | 1.59 | 0.059 | 0.0206 | 0.011 | 0.0030 | 0.0020 |
| 21 | Ti→Al→Mg | 0.0034 | 0.060 | 0.40 | 2.39 | 0.050 | 0.0103 | 0.012 | 0.0044 | 0.0015 |
| 22 | Ti→Al→Mg | 0.0027 | 0.102 | 0.36 | 0.60 | 0.055 | 0.0099 | 0.010 | 0.0031 | 0.0017 |
| 23 | Ti→Al→Mg | 0.0039 | 0.090 | 0.28 | 1.58 | 0.261 | 0.0101 | 0.010 | 0.0026 | 0.0019 |
| 24 | Ti→Al→Mg | 0.0050 | 0.089 | 0.29 | 1.54 | 0.060 | 0.0080 | 0.035 | 0.0040 | 0.0029 |
| 25 | Ti→Al→Mg | 0.0189 | 0.080 | 0.31 | 1.50 | 0.054 | 0.0098 | 0.009 | 0.0039 | 0.0146 |
| 26 | Ti→Al | 0.0034 | 0.103 | 0.26 | 1.53 | 0.057 | 0.0120 | 0.008 | 0.0033 | 0.0025 |
| 27 | Ti→Al→Mg | 0.0024 | 0.151 | 0.29 | 1.79 | 0.059 | 0.0104 | 0.011 | 0.0033 | 0.0018 |
| 28 | Ti→Al→Mg | 0.0028 | 0.070 | 0.35 | 1.20 | 0.050 | 0.0190 | 0.015 | 0.0025 | 0.0015 |
| 29 | Ti→Al +Mg | 0.0055 | 0.081 | 0.30 | 1.49 | 0.055 | 0.0070 | 0.009 | 0.0024 | 0.0023 |

| Component No. | Chemical composition (mass %) Mg | Ni | Cr | Cu | Mo | Nb | B | Ca | Ceq | Remarks |
|---|---|---|---|---|---|---|---|---|---|---|
| 1 | 0.0019 | | | | | | | | 0.43 | Example |
| 2 | 0.0003 | | | | | | | | 0.45 | |
| 3 | 0.0018 | 0.15 | 0.10 | 0.16 | 0.060 | | | 0.0044 | 0.47 | |
| 4 | 0.0037 | | | | | | | | 0.46 | |
| 5 | 0.0020 | 0.20 | | 0.21 | 0.030 | | | 0.0022 | 0.44 | |
| 6 | 0.0025 | 0.19 | | 0.20 | | | | 0.0025 | 0.41 | |
| 7 | 0.0019 | 0.45 | | 0.35 | 0.245 | | | | 0.36 | |
| 8 | 0.0023 | 0.20 | | 0.20 | 0.062 | | | 0.0010 | 0.32 | |
| 9 | 0.0023 | | | | | | | | 0.35 | |
| 10 | 0.0025 | 0.20 | | 0.24 | 0.029 | 0.008 | | 0.0024 | 0.39 | |
| 11 | 0.0048 | 0.21 | | 0.20 | 0.040 | | | | 0.40 | |
| 12 | 0.0029 | 0.25 | | 0.45 | 0.151 | 0.005 | | | 0.39 | |
| 13 | 0.0024 | 0.40 | | | | | 0.0019 | 0.0029 | 0.37 | |
| 14 | 0.0022 | | | | | | | | 0.35 | |

TABLE 1-continued

| | | | | | | | | | | |
|---|---|---|---|---|---|---|---|---|---|---|
| 15 | 0.0015 | 0.15 | | 0.15 | | | 0.0009 | | 0.36 | |
| 16 | 0.0012 | 0.15 | 0.10 | 0.16 | 0.030 | | | 0.0031 | 0.42 | |
| 17 | 0.0020 | | | | | 0.003 | 0.0010 | | 0.37 | |
| 18 | 0.0021 | | | | | | | 0.0019 | 0.47 | Comparative Example |
| 19 | 0.0019 | 0.40 | | 0.40 | 0.030 | | | | 0.31 | |
| 20 | 0.0025 | 0.22 | | 0.20 | 0.050 | | 0.0010 | | 0.42 | |
| 21 | 0.0024 | 0.15 | | 0.15 | | | | | 0.49 | |
| 22 | 0.0031 | 0.30 | 0.20 | 0.30 | 0.133 | | | 0.0015 | 0.32 | |
| 23 | 0.0019 | 0.25 | 0.10 | 0.20 | 0.051 | | | 0.0010 | 0.47 | |
| 24 | 0.0018 | 0.21 | | 0.19 | 0.051 | | | | 0.39 | |
| 25 | 0.0025 | 0.17 | | 0.21 | | | 0.0012 | | 0.37 | |
| 26 | — | | | | | | 0.0014 | | 0.37 | |
| 27 | 0.0018 | 0.25 | 0.20 | 0.20 | 0.050 | | | | 0.54 | |
| 28 | 0.0021 | | | 0.10 | | | | | 0.29 | |
| 29 | 0.0020 | 0.20 | | 0.10 | | | | | 0.36 | |

TABLE 2

| Production No. | Component No. | Flange thickness [mm] | Heating temperature [° C.] | Rolling finishing temperature [° C.] | Cooling rate (strength evaluation portion) [° C./s] | Recuperation temperature [° C.] | Remarks |
|---|---|---|---|---|---|---|---|
| 1 | 1 | 100 | 1150 | 900 | 3.2 | 550 | Example |
| 2 | 2 | 140 | 1330 | 950 | 2.7 | 680 | Example |
| 3 | 3 | 140 | 1330 | 950 | 2.7 | 680 | Example |
| 4 | 4 | 140 | 1300 | 950 | 2.6 | 600 | Example |
| 5 | 5 | 125 | 1300 | 920 | 3.0 | 450 | Example |
| 6 | 5 | 125 | 1300 | 750 | 3.0 | 450 | Comparative Example |
| 7 | 5 | 125 | 1300 | 920 | 2.0 | 600 | Comparative Example |
| 8 | 5 | 125 | 1300 | 920 | 3.0 | 720 | Comparative Example |
| 9 | 5 | 125 | 1300 | 920 | 3.0 | 220 | Comparative Example |
| 10 | 6 | 125 | 1300 | 920 | 2.8 | 550 | Example |
| 11 | 7 | 100 | 1150 | 860 | 3.3 | 500 | Example |
| 12 | 8 | 100 | 1150 | 860 | 3.3 | 500 | Example |
| 13 | 9 | 140 | 1330 | 950 | 2.5 | 420 | Example |
| 14 | 10 | 125 | 1250 | 920 | 2.8 | 330 | Example |
| 15 | 11 | 125 | 1250 | 920 | 3.0 | 330 | Example |
| 16 | 11 | 125 | 1300 | 720 | 3.0 | 450 | Comparative Example |
| 17 | 11 | 125 | 1300 | 950 | 1.9 | 650 | Comparative Example |
| 18 | 11 | 125 | 1300 | 950 | 3.0 | 710 | Comparative Example |
| 19 | 11 | 125 | 1300 | 950 | 3.0 | 180 | Comparative Example |
| 20 | 12 | 150 | 1300 | 980 | 2.5 | 500 | Example |
| 21 | 13 | 150 | 1300 | 980 | 2.5 | 500 | Example |
| 22 | 14 | 140 | 1300 | 950 | 2.7 | 620 | Example |
| 23 | 15 | 140 | 1300 | 950 | 2.7 | 620 | Example |
| 24 | 16 | 100 | 1150 | 880 | 3.3 | 600 | Example |
| 25 | 17 | 100 | 1150 | 880 | 3.3 | 600 | Example |
| 26 | 18 | 125 | 1300 | 950 | 3.0 | 550 | Comparative Example |
| 27 | 19 | 125 | 1300 | 950 | 3.0 | 550 | Comparative Example |
| 28 | 20 | 125 | 1300 | 950 | 2.8 | 550 | Comparative Example |
| 29 | 21 | 125 | 1300 | 950 | 2.8 | 550 | Comparative Example |
| 30 | 22 | 125 | 1300 | 920 | 3.0 | 600 | Comparative Example |
| 31 | 23 | 125 | 1300 | 920 | 3.0 | 600 | Comparative Example |
| 32 | 24 | 125 | 1300 | 950 | 3.0 | 620 | Comparative Example |
| 33 | 25 | 125 | 1300 | 950 | 2.8 | 620 | Comparative Example |
| 34 | 26 | 125 | 1300 | 950 | 2.8 | 620 | Comparative Example |
| 35 | 27 | 125 | 1300 | 950 | 3.0 | 620 | Comparative Example |
| 36 | 28 | 125 | 1300 | 950 | 3.0 | 620 | Comparative Example |
| 37 | 29 | 125 | 1300 | 950 | 2.8 | 400 | Comparative Example |

TABLE 3

| Production No. | Number density of Mg-containing oxides [pieces/mm$^2$] | Strength evaluation portion: Average prior γ grain size [μm] | Strength evaluation portion: Fraction of bainite [%] | Strength evaluation portion: YS [MPa] | Strength evaluation portion: TS [MPa] | Toughness evaluation portion: Average prior γ grain size [μm] | Toughness evaluation portion: vE21° C. [J] | Remarks |
|---|---|---|---|---|---|---|---|---|
| 1 | 1011 | 114 | 87 | 490 | 634 | 159 | 215 | Example |
| 2 | 120 | 149 | 92 | 495 | 629 | 198 | 167 | Example |
| 3 | 383 | 149 | 96 | 513 | 633 | 180 | 202 | Example |
| 4 | 4423 | 124 | 90 | 489 | 620 | 137 | 181 | Example |
| 5 | 2769 | 128 | 92 | 488 | 636 | 150 | 186 | Example |
| 6 | 2809 | 50 | 67 | 420 | 542 | 151 | 242 | Comparative Example |
| 7 | 2488 | 100 | 70 | 423 | 549 | 153 | 189 | Comparative Example |
| 8 | 2557 | 105 | 63 | 405 | 545 | 149 | 201 | Comparative Example |
| 9 | 2653 | 104 | 93 | 549 | 694 | 155 | 39 | Comparative Example |
| 10 | 1150 | 101 | 91 | 479 | 615 | 169 | 216 | Example |
| 11 | 870 | 89 | 87 | 468 | 608 | 174 | 189 | Example |
| 12 | 1234 | 85 | 81 | 455 | 590 | 159 | 249 | Example |
| 13 | 990 | 133 | 85 | 464 | 606 | 164 | 214 | Example |
| 14 | 850 | 120 | 89 | 477 | 627 | 170 | 200 | Example |
| 15 | 4227 | 99 | 94 | 496 | 624 | 140 | 201 | Example |
| 16 | 4011 | 52 | 73 | 433 | 555 | 148 | 230 | Comparative Example |
| 17 | 3990 | 110 | 75 | 431 | 567 | 148 | 199 | Comparative Example |
| 18 | 4236 | 128 | 59 | 389 | 520 | 144 | 220 | Comparative Example |
| 19 | 4205 | 120 | 94 | 560 | 697 | 140 | 74 | Comparative Example |
| 20 | 1022 | 148 | 93 | 490 | 627 | 168 | 160 | Example |
| 21 | 221 | 140 | 98 | 489 | 623 | 185 | 232 | Example |
| 22 | 988 | 105 | 84 | 460 | 599 | 170 | 141 | Example |
| 23 | 189 | 106 | 93 | 475 | 621 | 188 | 190 | Example |
| 24 | 1742 | 79 | 98 | 484 | 620 | 164 | 244 | Example |
| 25 | 3021 | 78 | 90 | 468 | 599 | 152 | 230 | Example |
| 26 | 3787 | 120 | 97 | 494 | 626 | 149 | 70 | Comparative Example |
| 27 | 1996 | 129 | 81 | 430 | 544 | 155 | 209 | Comparative Example |
| 28 | 2104 | 123 | 94 | 480 | 601 | 160 | 51 | Comparative Example |
| 29 | 1443 | 97 | 98 | 525 | 664 | 168 | 58 | Comparative Example |
| 30 | 1887 | 100 | 75 | 439 | 565 | 161 | 198 | Comparative Example |
| 31 | 1675 | 104 | 95 | 495 | 638 | 160 | 64 | Comparative Example |
| 32 | 2234 | 149 | 90 | 478 | 614 | 155 | 49 | Comparative Example |
| 33 | 490 | 125 | 89 | 468 | 622 | 180 | 46 | Comparative Example |
| 34 | 0 | 129 | 89 | 480 | 640 | 320 | 67 | Comparative Example |
| 35 | 1020 | 113 | 99 | 556 | 687 | 160 | 65 | Comparative Example |
| 36 | 489 | 110 | 71 | 410 | 531 | 171 | 223 | Comparative Example |
| 37 | 37 | 105 | 90 | 480 | 599 | 305 | 77 | Comparative Example |

INDUSTRIAL APPLICABILITY

According to the present invention, it is possible to obtain a high strength ultra thick H-section steel having a flange thickness of 100 mm to 150 mm and excellent toughness. The high strength ultra thick H-section steel has an yield strength or 0.2% proof stress of 450 MPa or more, a tensile strength of 550 MPa or more, and a Charpy absorbed energy at 21° C. of 100 J or more, and thus has both excellent toughness and high strength. In addition, the high strength ultra thick H-section steel according to the present invention can be produced without adding a large amount of alloys or reducing carbon to the ultra low carbon level, which causes significant steel-making loads. Accordingly, this makes it possible to reduce production costs and shorten production time, thereby achieving a significant reduction in costs. Therefore, according to the present invention, the reliability of large buildings can be improved without sacrificing cost efficiency, and hence, the present invention makes an extremely significant contribution to industry.

BRIEF DESCRIPTION OF THE REFERENCE SYMBOLS

1: HEATING FURNACE
2*a*: ROUGHING MILL
2*b*: INTERMEDIATE ROLLING MILL
2*c*: FINISHING MILL
3*a*: WATER COOLING DEVICES ARRANGED AT FRONT AND BACK OF INTERMEDIATE ROLLING MILL
3*b*: WATER COOLING DEVICE ARRANGED AT BACK OF FINISHING MILL
4: H-SECTION STEEL
5: FLANGE
6: WEB
7: STRENGTH EVALUATION PORTION
8: TOUGHNESS EVALUATION PORTION
F: ENTIRE FLANGE LENGTH
H: HEIGHT
$t_1$: WEB THICKNESS
$t_2$: FLANGE THICKNESS

What is claimed is:

1. An H-section steel comprising, as a chemical composition, by mass %:

C: 0.05% to 0.16%;
Si: 0.01% to 0.50%;
Mn: 0.70% to 2.00%;
V: 0.01% to 0.20%;
Al: 0.0001% to 0.10%;
Ti: 0.003% to 0.030%;
N: 0.0010% to 0.0200%;
O: 0.0001% to 0.0100%;
Mg: 0.0003% to 0.0050%;
Ni: 0% to 0.50%;
Cr: 0% to 0.50%;

Cu: 0% to 0.50%;
Mo: 0% to 0.30%;
Nb: 0% to 0.010%;
B: 0% to 0.0020%;
Ca: 0% to 0.0050%; and
a remainder of Fe and impurities,
wherein a carbon equivalent $C_{eq}$ obtained by the following Equation 1 is 0.30% to 0.50%;
a Mg-containing oxide having an equivalent circle diameter of 0.005 μm to 0.5 μm at a total number density of 100 pieces/mm$^2$ to 5000 pieces/mm$^2$;
a thickness of a flange is 100 mm to 150 mm;
at a strength evaluation portion which is at a ⅙ position from a surface of the flange in a length direction and at a ¼ position from the surface in a thickness direction, a fraction of bainite in a steel structure is 80% or more, and an average prior austenite grain size is 70 μm or more; and
at a toughness evaluation portion which is at a ½ position from the surface of the flange in the length direction and at a ¾ position from the surface of the flange in the thickness direction, the average prior austenite grain size in a steel structure is 200 μm or less, $$C_{eq}=C+Mn/6+(Cr+Mo+V)/5+(Ni+Cu)/15 \quad \text{Equation (1),}$$

wherein C, Mn, Cr, Mo, V, Ni, and Cu represent the amount of each element contained by mass % and the amount of an element not contained is 0.

2. The H-section steel according to claim 1,
wherein the H-section steel includes, as the chemical composition, by mass %, one or more of
Ni: 0.01% to 0.50%,
Cr: 0.01% to 0.50%,
Cu: 0.01% to 0.50%,
Mo: 0.001% to 0.30%,
Nb: 0.001% to 0.010%,
B: 0.0001% to 0.0020%, and
Ca: 0.0001% to 0.0050%.

3. The H-section steel according to claim 1,
wherein, at the strength evaluation portion at room temperature, a yield strength or 0.2% proof stress is 450 MPa or more, and a tensile strength is 550 MPa or more; and
at the toughness evaluation portion, a Charpy absorbed energy at a test temperature of 21° C. is 100 J or more.

4. A method of producing an H-section steel, the method comprising:
a refining step which performs deoxidizing to cause a concentration of oxygen in a molten steel to be 0.0020% to 0.0100%, then sequentially adding Ti, Al, and Mg, and adjusting a chemical composition of the molten steel to include by mass %, C: 0.05% to 0.16%, Si: 0.01% to 0.50%, Mn: 0.70% to 2.00%, V: 0.01% to 0.20%, Al: 0.0001% to 0.10%, Ti: 0.003% to 0.030%, N: 0.0010% to 0.0200%, O: 0.0001% to 0.0100%, Mg: 0.0003% to 0.0050%, Ni: 0% to 0.50%, Cr: 0% to 0.50%, Cu: 0% to 0.50%, Mo: 0% to 0.30%, Nb: 0% to 0.010%, B: 0% to 0.0020%, Ca: 0% to 0.0050%, and a remainder of Fe and impurities, and to have a carbon equivalent $C_{eq}$ obtained by the following Equation 2 of 0.30% to 0.50%;
a casting step which casts the molten steel to obtain a steel piece;
a heating step which heats the steel piece to 1100° C. to 1350° C.;
a hot-rolling step which performs rolling on the heated steel piece such that a surface temperature of 850° C. or higher when the rolling is finished, thereby obtaining the H-section steel; and
a cooling step which performs water-cooling the H-section steel after the hot-rolling step;
wherein Al and Mg are added after 1 minute or longer has passed from the addition of the previous element;
wherein in the cooling step, water cooling conditions are controlled so that a cooling rate in a range from 800° C. to 600° C. at a ⅙ position from a surface of a flange in a length direction and at a ¼ position from the surface of the flange in a thickness direction is 2.2° C./s or more and the surface temperature after stopping the water-cooling is recuperated within a temperature range of 300° C. to 700° C., $$C_{eq}=C+Mn/6+(Cr+Mo+V)/5+(Ni+Cu)/15 \quad \text{Equation 2,}$$

wherein C, Mn, Cr, Mo, V, Ni, and Cu represent the amount of each element contained by mass % and the amount of an element not contained is 0.

5. The method of producing an H-section steel according to claim 4,
wherein the H-section steel includes, as the chemical composition, by mass %, one or more of
Ni: 0.01% to 0.50%,
Cr: 0.01% to 0.50%,
Cu: 0.01% to 0.50%,
Mo: 0.001% to 0.30%,
Nb: 0.001% to 0.010%,
B: 0.0001% to 0.0020%, and
Ca: 0.0001% to 0.0050%.

6. The H-section steel according to claim 2,
wherein, at the strength evaluation portion at room temperature, a yield strength or 0.2% proof stress is 450 MPa or more, and a tensile strength is 550 MPa or more; and
at the toughness evaluation portion, a Charpy absorbed energy at a test temperature of 21° C. is 100 J or more.

* * * * *